United States Patent [19]

Boyanich

[11] 4,313,314

[45] Feb. 2, 1982

[54] AIR CONDITIONER/HEAT PUMP CONVERSION APPARATUS

[75] Inventor: Joseph E. Boyanich, Hixson, Tenn.

[73] Assignee: Alan Ruderman, Chattanooga, Tenn. ; a part interest

[21] Appl. No.: 176,253

[22] Filed: Aug. 7, 1980

[51] Int. Cl.[3] ..... F25B 13/00

[52] U.S. Cl. ..... 62/324.1; 62/324.6

[58] Field of Search ..... 62/324.1, 324.6, 324.7

[56] References Cited

U.S. PATENT DOCUMENTS

| | | | |
|---|---|---|---|
| 2,974,682 | 3/1961 | Trask | 62/324.6 |
| 3,411,538 | 11/1968 | Gruner et al. | 62/324.6 |
| 3,867,960 | 2/1975 | Hosoda et al. | 62/324.6 |
| 4,178,768 | 12/1979 | Pauliukonis | 62/324.6 |

*Primary Examiner*—Lloyd L. King

*Attorney, Agent, or Firm*—Alan Ruderman

[57] ABSTRACT

Heat pump/air conditioning converter apparatus for directing a refrigerant from a compressor to a first heat exchanger located within a building and a second heat exchanger located outside the building for selectively cooling and heating the first heat exchanger. The apparatus has a housing within which a reversing valve, a liquid refrigerant flow control valve system, an expansion valve and an accumulator tank is incorporated. The housing has a number of cavities for receiving the various components of the valves and tank, and a number of passageways for directing the refrigerant to the components to minimize the number of external connections. The reversing valve incorporates an axially slideable rod having a large main piston positioned centrally thereon and a pair of smaller valve opening/closing piston members at each end, one end controlling the hot high pressure gaseous refrigerant and the other end controlling the low pressure relatively cool gaseous refrigerant. The liquid refrigerant flow control valve includes a ball valve moved by high pressure fluid and a pair of check valves in the low pressure liquid path from the expansion valve. The accumulator is disposed between the gaseous portion of the apparatus and the liquid portion of the apparatus and includes accessible filter elements in the liquid and the gaseous path.

7 Claims, 8 Drawing Figures

AIR CONDITIONER/HEAT PUMP CONVERSION APPARATUS

BACKGROUND OF THE INVENTION

This invention relates to air conditioning and heating and more particularly to apparatus for converting an air conditioner into a heat pump with a reduction in energy loss and with a minimum of elements and fittings.

Heat pumps for residential heating purposes are relatively low cost systems especially in the southern regions of the nation. Conventional heat pump units however have a multitude of complex components which must be connected together by tubing, fittings etc., the whole tending to raise the initial cost of purchasing and installing such units. Additionally, if it is desired to convert an air conditioner into a heat pump for use during the heat season, the additional required components presently available are such that the cost of conversion becomes impractical. For example, the available reversing valves, check valves, expansion valves etc. that must be purchased and the complexities of installing the units result in costs similar to those of purchasing a heat pump initially. Moreover, the known reversing valves which are of the D-valve type are relatively inefficient since the hot and cold fluids are in adjoining portions and heat losses tend to occur. Furthermore, a large number of lines and fittings are required for their installation and these lines additionally result in heat losses. This is similarly true of the available check valves and expansion valves required. In addition, conventional refrigerant accumulator tanks, which should be used to eliminate liquid refrigerant from being dumped into the compressor at start-up during intermittent operation, are installed in the systems in a similar manner, as are the filters required to protect the system. The fluid lines in almost all cases must be sweat soldered onto the components and this frequently results in metal flakes entering the lines and creating damage to the critical elements, especially to the compressor.

SUMMARY OF THE INVENTION

Consequently, it is a primary object of the present invention to provide a simplified apparatus for converting a conventional air conditioning system for use as a heat pump.

It is another object of the present invention to provide in an integral body member a reversing valve, check valves, and an expansion valve for converting an air conditioning cycle selectively into a heat pump cycle with the utilization of a minimum of external connections and fittings.

It is a further object of the present invention to provide a reversing valve for use in a heat pump/air conditioning system which maintains the hot and cold fluids at spaced apart portions of the valve thereby minimizing heat losses and improving the efficiency of the system.

It is a still further object of the present invention to provide a simply constructed liquid refrigerant flow valve for a heat pump/air conditioning system for directing liquid refrigerant from and to the inside and outside heat exchange coils selectively, the valve having a first section controlling the liquid from one of the heat exchange coils to the expansion valve and a second section controlled by the first section and directing the liquid from the expansion valve to the other of the coils.

It is a yet further object of the present invention to provide an accumulator tank for a heat pump/air conditioning system having internal liquid and vapor filter elements and which may be constructed integral with the gas and/or liquid valving of the system.

The present invention accomplishes these objects and overcomes the problems of the prior art by providing a structure incorporating the various components required for converting an air conditioning system into a heat pump system with a minimum of expense and installation effort. The structure may be a single body member having various cavities therein for receiving the components. For example, the body member incorporates a novel expansion valve structure which maintains the hot and cold gases spaced apart in the body to minimize heat losses in the valve. It also incorporates a novel liquid flow check valve and an expansion valve. The accumulator tank, also having novel features, may be incorporated in or attached to the body member. The body member may be so constructed to form a relatively small block member which can be fitted into conventional air conditioning units, including window units, to convert the system into a heat pump.

According to a preferred aspect of the invention there is provided a reversing valve incorporating an axially slideable rod having a piston member substantially centrally located thereon and a pair of valve closing piston elements at each end thereof. High pressure is applied to a selective side of the piston determined by the mode of operation to drive the rod in the direction to close a first port and open a second port at each end of the valve. A first end of the valve always communicates with the discharge line from the compressor while the second end of the valve always communicates with the inlet to the compressor preferably through the accumulator. Depending on the axial position of the valve the first end of the valve also communicates with either the inside or the outside heat exchanger coil while the second end communicates with the other of the inside or outside heat exchanger coil.

Another aspect of the invention is the liquid refrigerant flow valve which includes a first check valve section that directs the high pressure liquid from either the inside coil during the heating mode or the outside coil during the cooling mode to the expansion valve preferably first through the accumulator, and has a second check valve section which directs the low pressure liquid refrigerant from the expansion valve to the outside heat exchanger coil during the heating mode or the inside heat exchanger coil during the cooling mode. The first section includes a ball check valve controlled and directed by the high pressure liquid. The second section includes a pair of check valve closure members oppositely disposed in relation to the low pressure path and biased toward the position to close the path to both heat exchanger coils, the bias being opposed by the low pressure liquid acting against a closure face of both members, and the bias on one member being aided by the high pressure liquid, the path of which is controlled by the ball valve from the inside heat exchanger coil during the heating mode or the outside heat exchanger coil during the cooling mode, the low pressure liquid being directed to the other of the heat exchanger coils.

Another aspect of the invention is the accumulator tank through which high pressure liquid is directed to obtain additional sub-cooling and which allows slugback liquid trapped in the low pressure vapor to drip out and evaporate. The accumulator is constructed to receive a replaceable filter element in the high pressure liquid path and a replaceable filter element in the vapor path to the suction side of the compressor.

BRIEF DESCRIPTION OF THE DRAWINGS

The particular features and advantages of the invention as well as other objects will become apparent from the following description taken in conjunction with the following drawings, in which.

DESCRIPTION OF THE PREFERRED EMBODIMENT

Figure 1:
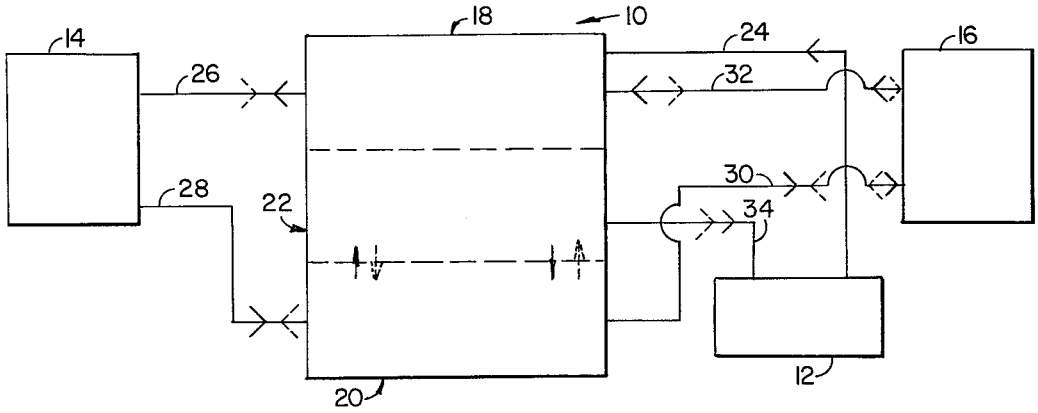
FIG. 1 is a diagrammatic view of a heat pump/air conditioner system incorporating cycle converting apparatus constructed in accordance with the principles of the present invention.

Referring to FIG. 1 a heat pump/air conditioning system is illustrated diagrammatically incorporating the converter apparatus 10 of the present invention in the system with a compressor 12, an inside heat exchanger coil 14 conventionally located within the furnace of a building whose internal environment is to be controlled, and an outside exchanger coil 16 located outside the building and utilizing ambient atmospheric conditions as a heat sink. The converter 10 preferably comprises a body member in the form of a metallic or plastic block which may be cast with a number of cavities as hereinafter described. In the preferred form, as illustrated, the gas portion 18 of the converter is disposed in the upper part of the block while the liquid portion 20 is disposed in the lower part of the block, the accumulator portion 22 preferably being sandwiched between the gas and liquid portions. It should be understood however, that the various portions of the converter may be disposed in a different relationship, for example the liquid portion may be on top with the gas portion on the bottom, or the gas portion may be on top with the accumulator in the bottom. With the disposition as illustrated in the preferred embodiment a minimum of passageways are required to be machined.

FIG. 1 illustrates the basic operation of the cycle the solid arrows illustrating the fluid flow path in the heating mode and the dotted arrows illustrating the path of fluid flow in the cooling mode. In the heating mode high pressure relatively hot gas is discharged from the compressor through line 24 and is directed through the gas portion of the converter, through a line 26 to the inside heat exchanger coil 14 where its heat is transferred to the furnace of the building and in so doing is condensed to a liquid. The high pressure liquid thereafter flows through a line 28 into the liquid portion 20 of the converter and is there directed into the accumulator 22 where it is further sub-cooled and redirected back into the liquid portion of the converter through an expansion valve located therein. The liquid undergoes a drop in pressure in the expansion valve and is directed by the liquid refrigerant flow valve in the liquid portion through a line 30 to the outside heat exchange coil 16 where it takes on heat and vaporizes. The low pressure vapor thereafter flows through a line 32 from the heat exchanger 16 back to the gas portion 18 of the converter and is directed to an inlet line 34 back to an inlet of the compressor 12, preferably passing first through the accumulator 22 where it allows trapped liquid to precipitate out.

In the cooling mode the high pressure vapor from the compressor again is directed through line 24 to the reversing valve in the gas portion 18 of the converter. The reversing valve in this mode is positioned to direct the high pressure vapor through line 32 to the outside coil 16 where it gives up heat and condenses into a liquid. The high pressure liquid is discharged from the outside heat exchange coil 16 through line 30 and enters the liquid portion 20 of the converter and is there directed to the accumulator. The liquid flows back from the accumulator to the liquid refrigerant flow valve of the liquid portion of the converter where the pressure is dropped and which directs the liquid through line 28 to the inside heat exchange coil 14 where it takes on heat to cool the furnace of the building and vaporizes. The low pressure vapor flows back to the gas portion 18 of the converter and is directed by the reversing valve back to the inlet line 34 to the compressor preferably first passing through the accumulator.

Figure 3:
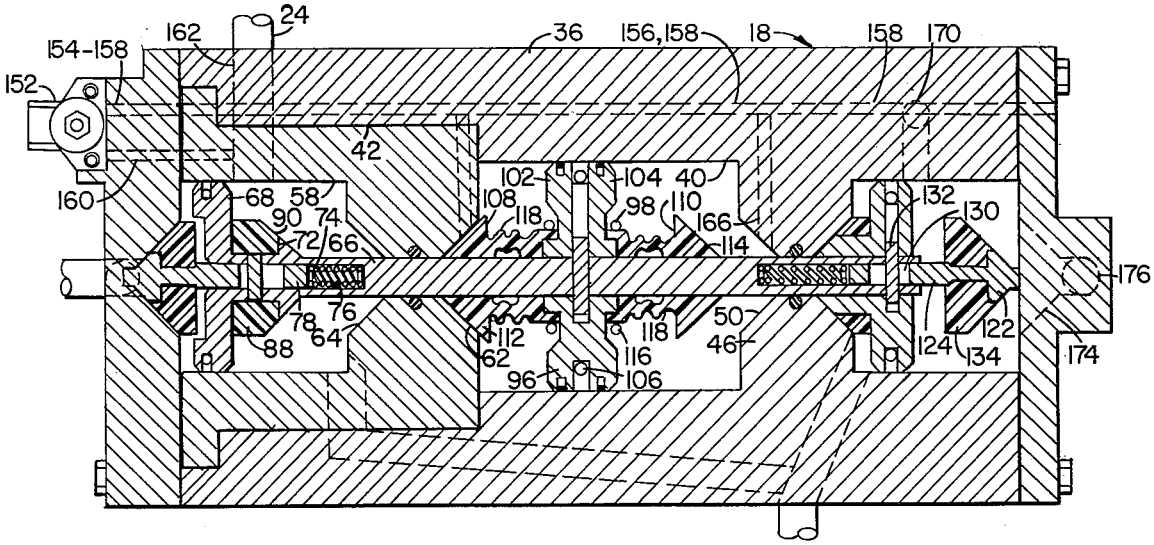
FIG. 3 is a horizontal cross-sectional view through the gas portion of the converter taken substantially along line 3—3 of FIG. 2 and illustrating the reversing valve in the heat pump or heating mode.
Figure 4:
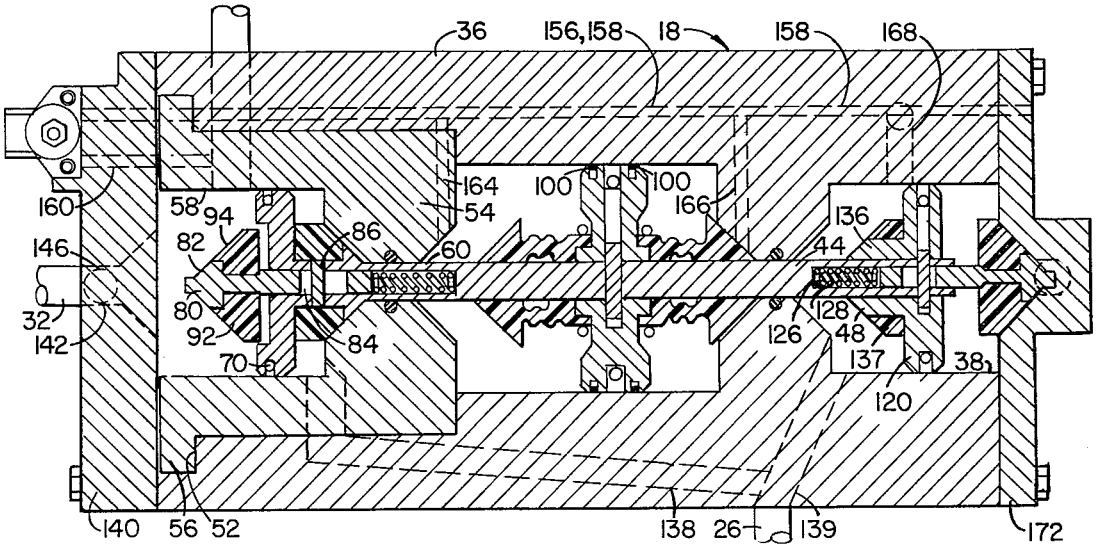
FIG. 4 is a view similar to FIG. 3 but with the reversing valve in the air conditioning or cooling mode.
Figure 2:
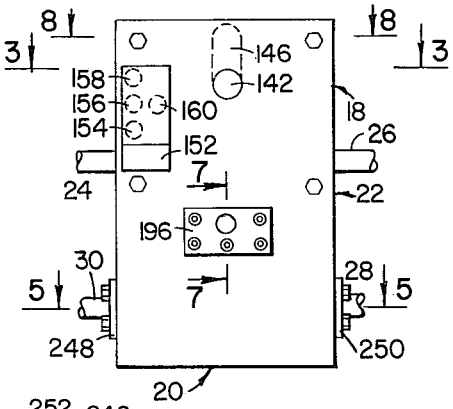
FIG. 2 is an end elevational view of the cycle converter apparatus constructed in accordance with the preferred form of the invention.

Referring to FIGS. 2, 3 and 4, the gas portion 18 of the converter comprises a valve body 36 forming the upper portion of the converter block and having three substantially concentric cavities 38,40,42 formed therein. The cavities are substantially cylindrical in configuration and open into each other. Cavity 38 is smaller than cavity 40 and communicates therewith through a small substantially centrally located cylindrical opening 44, the wall 46 between these cavities having countersunk conical surfaces 48 and 50 where the respective cavity 38,40 open into the bore 44. The cavity 42 may be larger than the cavity 40 and includes a counterbored portion 52 at the end remote from the cavity 40. Positioned within the cavity 42 is a cylindrical insert 54 having an outer flange 56 disposed in the counterbore 52. The insert 54 includes a substantially centrally disposed cylindrical annulus 58 of substantially the same internal diameter as that of the cavity 38 and a concentric bore 60 of similar size as the bore 44. The outer wall of the insert 54 where it abuts the cavity 40 includes a countersunk conical surface 62 where the cavity 40 opens onto the bore 60, the surface 62 being similar to the surface 50 on the opposite side of the cavity. Similarly a countersunk surface 64 is formed where the cavity 58 of the insert 54 opens onto the bore 60.

Positioned within the cavities and slideably receivable within the bores 60 and 44 is a main piston rod 66 preferably having an integral piston member 68 formed on one end thereof of a diameter substantially equal to that of the diameter of the cavity 58, a sealing ring 70 being disposed within a peripheral slot in the piston 68. On the same end of the rod 66 as the piston 68 but spaced therefrom is a conical surface 72 of a shape complementary to a portion of the surface 64. An axial bore 74 is formed in that same end of the rod 66 through the piston 68 and beyond the surface 72. Seated in the closed end of the bore 74 is a coil spring 76 and positioned axially on the spring is the rod portion 78 of a closing piston member 80 which has a conical outer surface configuration as illustrated at 82. The rod portion 78 includes a slotted cutout 84 which receives a pin 86 for securing the rod 78 to the main rod 66 while allowing axial movement therebetween. The spring 76 and the slotted cutout 84 provide compensation for machining inaccuracies to allow the piston 80 to seal properly as hereinafter described. Positioned about the main rod 66 abutting the piston 68 is a rubber or neopreme seal 88 having a surface 90 of a truncated conical configuration complementary to the surface 72, the whole adapted to be securely received in sealing relationship against the surface 64 of the insert. A similar seal 92 is disposed about the rod 78 and abutting the adjacent portion of the piston 80, the seal 92 having a truncated concical surface 94 forming a continuation of the conical surface 82 of the piston 80.

Disposed on the main piston rod 66 within the cavity 40 is a main piston 96 secured thereon by a pin 98 or the like. The piston 96 is larger than the piston 68 and as hereafter explained provides the driving force for moving the rod 66 selectively. The piston 96 is of substantially the same diameter as the diameter of the cavity 40 and may include V-packing seals 100 on the periphery of the faces 102 and 104 and a sealing wiping element 106 intermediate thereof. Positioned about the rod 66 and secured onto a hub portion of each face 102,104 of the piston 96 is a respective rubber or neopreme seal member 108,110 which may have conical surface configurations 112,114 remote from the piston 96, each adapted to complement the facing conical surfaces 62,50 respectively of the insert 54 and the wall 46. The specific seals disclosed are not critical since seals of other configurations may be readily envisioned by those skilled in the art. Snap rings 116 may be positioned about the seals to firmly secure them to the piston at the respective face. The portion 118 of the seals 108,110 intermediate the conical surfaces and the point of attachment on the hubs of the piston 96 is radially spaced from the rod and provides a diaphragm type of resiliency such that when the piston is driven in a direction to engage the respective conical surface 112,114 with the seat 62,50 the sealing is complete, and to provide a resilient movement when the pressures are reversed at the initial stage of a mode change.

A piston 120 similar in construction to the piston 68 but preferably separate from the rod 66 is positioned on the end of the rod within the cavity 38. A sealing piston 122 formed integral with a rod portion 124 is positioned within an axial bore 126 in that end of the main rod 66 abutting a spring 128 in the same manner as the elements are mounted on the opposite end of the rod 66. Similarly, the rod portion 124 includes a slotted cutout 130 and a pin 132 secures the piston 120 to the rod 66 with axial play provided by the slot 130. A seal 134 similar in structure and configuration to the seal 92 and having a complementary conical configuration with the sealing piston 122 on the end of the seal remote from the piston 120 is positioned about the rod 124. On the opposite end of the piston 120 there is a hub 136 having a conical surface complementary to the surface 48 of the wall 46 and a seal 137 is disposed about the hub 136 and forms a continuation of the conical surface therewith, so that the hub 136 and the seal 137 are receivable in sealing engagement with the surface 48. A fluid passageway 138 communicates with and extends from the annulus 58 through the insert 54 and the valve body 38, and enters a similar fluid passageway 139 that extends from the cavity 38. The pathway 139 is connected to the external line 26 that runs to the inside heat exchanger 14.

Figure 8:
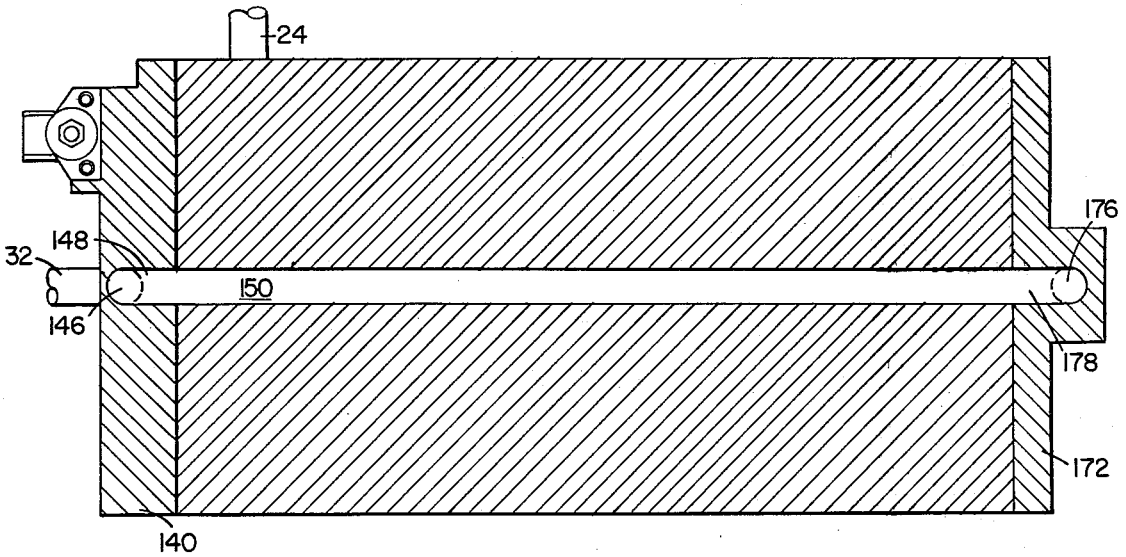
FIG. 8 is a horizontal cross-sectional view through the gas portion of the converter taken substantially along line 8—8 of FIG. 2.

Secured as by bolts in sealing engagement to the valve body 36 of the gas portion 18 of the converter block at the end adjacent the piston 68 is a manifold plate 140. The plate 140 includes a substantially central bore 142 extending therethrough and as best illustrated in FIG. 4 has a countersink 144 that flares out and communicates with the cavity 58. The configuration of the countersink 144 is complementary to that of the surfaces 82 and 84 of the sealing piston and seal 92 respectively. Extending upwardly within the plate 140 and communicating with the bore 142 is an internal bore 146 that as illustrated in FIG. 8 communicates at the upper end with a lateral bore 148. The bore 148 opens into and communicates with a lateral passageway 150 in the valve body 36 above the valve structures, the passageway 150 extending the length of the member 36.

Supported on the manifold plate 140 is a conventional electrical solenoid valve 152 controlled by a mode selector switch (not illustrated) within the building to be heated and cooled. The solenoid valve includes four ports 154,156,158,160 which communicate with small corresponding bores extending through the manifold plate and which for convenience and clarity of illustration are referenced by the same numbers, the bores 154-160 communicating with corresponding and similarly referenced bores extending varying distances laterally through the valve body 36. The bore 160 in the valve body 36 opens within the valve body in a passageway 162 that extends transversely from the cavity 58 to a port connected to the external line 24, to communicate the high pressure gas of the compressor 12 to the cavity 58 and to the solenoid valve. The bore 154 in the valve body communicates with a transversely extending passageway 164 entering cavity 40 at the conical surface 62, while the bore 156 communicates with a passageway 166 entering the cavity 40 at the conical surface 50. Communicating with the bore 158 is a larger transverse passageway 168 that extends transversely and opens into cavity 38. The passageway 168 also communicates with a passageway 170 that extends downwardly through the valve body and opens into the accumulator 22, as hereafter described.

A plate 172 is secured to the valve body 36 at the opposite end from plate 140 and has a central countersunk recess 174 complementary to the surfaces of the sealing piston 122 and seal 134 for sealing engagement. A passageway 176 extends upwardly within the plate 172 and communicates with a lateral bore 178 which in turn opens into and communicates with passageway 150 in the valve body, thereby communicating the outside coil 16 with the accumulator when members are positioned as illustrated in FIG. 3. The plate 172 may extend downwardly and also enclose the same end of the accumulator 22 and the liquid portion 20 of the converter assembly.

Figure 7:
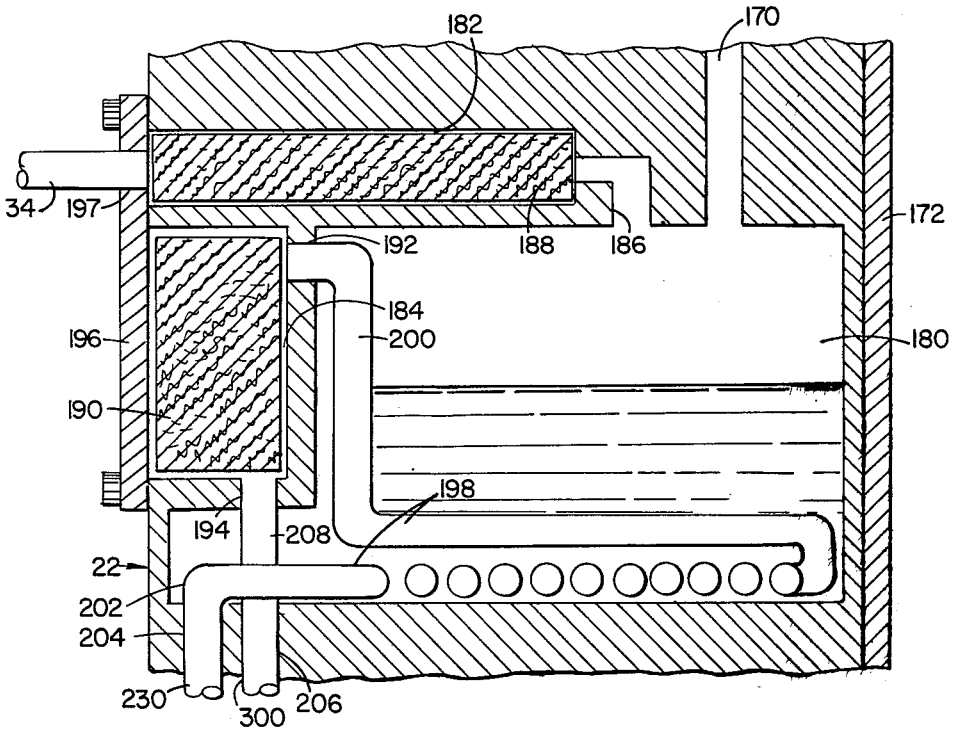
FIG. 7 is a fragmentary vertical cross-sectional view through the converter taken substantially along line 7—7 and illustrating the accumulator portion of the converter.

Referring now to FIG. 7, the accumulator portion 22 of the converter 10 is illustrated as formed in the same block member as the gas portion 18 and comprises a first cavity 180 and a pair of smaller cylindrically shaped cavities 182 and 184 separated therefrom within the block. The passageway 170 that extends down from the gas portion opens into the first cavity 180 and a second passageway 186 communicates the first cavity with the smaller cavity 182. Positioned within the small cavity 182 is a cylindrically shaped low pressure gas filter cartridge 188 of a conventional filter material. A similar high pressure liquid filter cartridge 190 is disposed within the cavity 184 which includes an inlet communicating with a bore 192 in the wall near the top thereof and an outlet communicating with a bore 194 in the wall at the bottom thereof. The filter cavities are open at the one end as viewed in FIG. 2 and a plate 196 is removably secured to the block to close the openings while allowing access to change the filters. The plate 196 includes a central opening 197 to communicate the compressor inlet line 34 with the cavity 182.

Disposed in the bottom of the large cavity 180 is a conduit in the form of a serpentine coil 198 which has one end 200 bent upwardly and secured to the bore 192 in flow communication therewith and has its other end bent downwardly and in communication with a first bore 204 in the bottom of the cavity 180. Another bore 206 adjacent the bore 204 communicates through a conduit 208 with the outlet of the liquid filter cavity 184 through a connection with the bore 194. Thus, liquid from the liquid portion of the converter enters the bore 204 flows through the coil 192, is further subcooled and flows through the filter 190 back into the liquid portion 20, while the low pressure gas enters the cavity 180 from line 170 and flows through filter 188 to the compressor, any trapped liquid in the gas line precipitating out into the bottom of the accumulator cavity 180 where it acts to subcool the liquid and evaporates.

Figure 5:
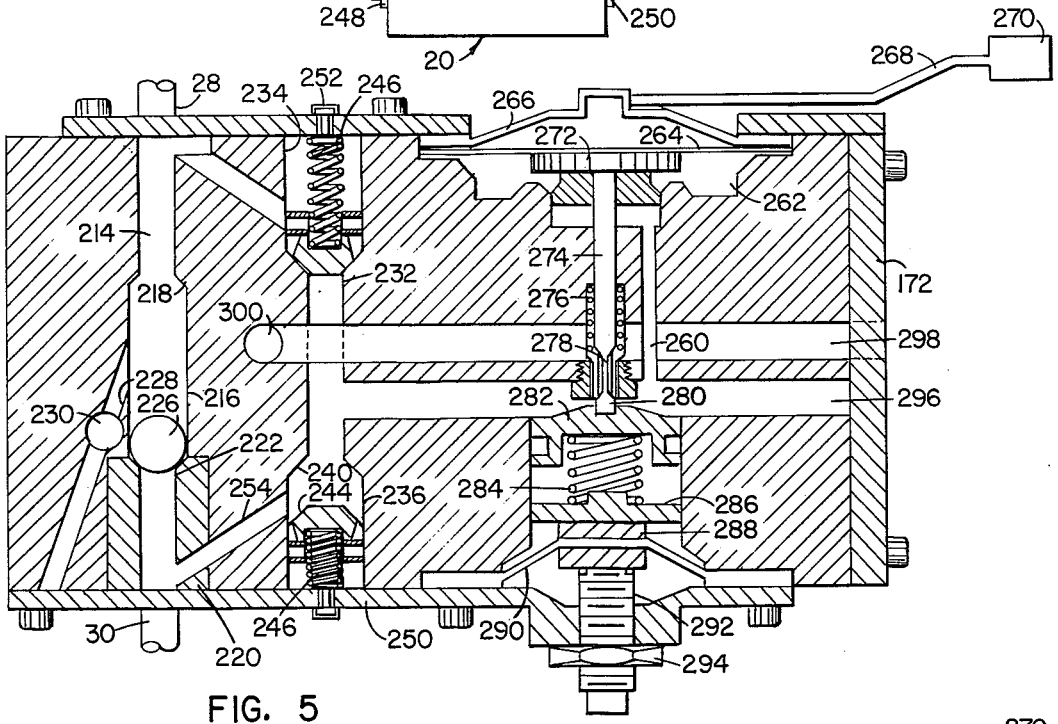
FIG. 5 is a horizontal cross-sectional view through the liquid portion of the converter taken substantially along line 5—5 of FIG. 2 and illustrating the liquid refrigerant flow valve in the heating mode.
Figure 6:
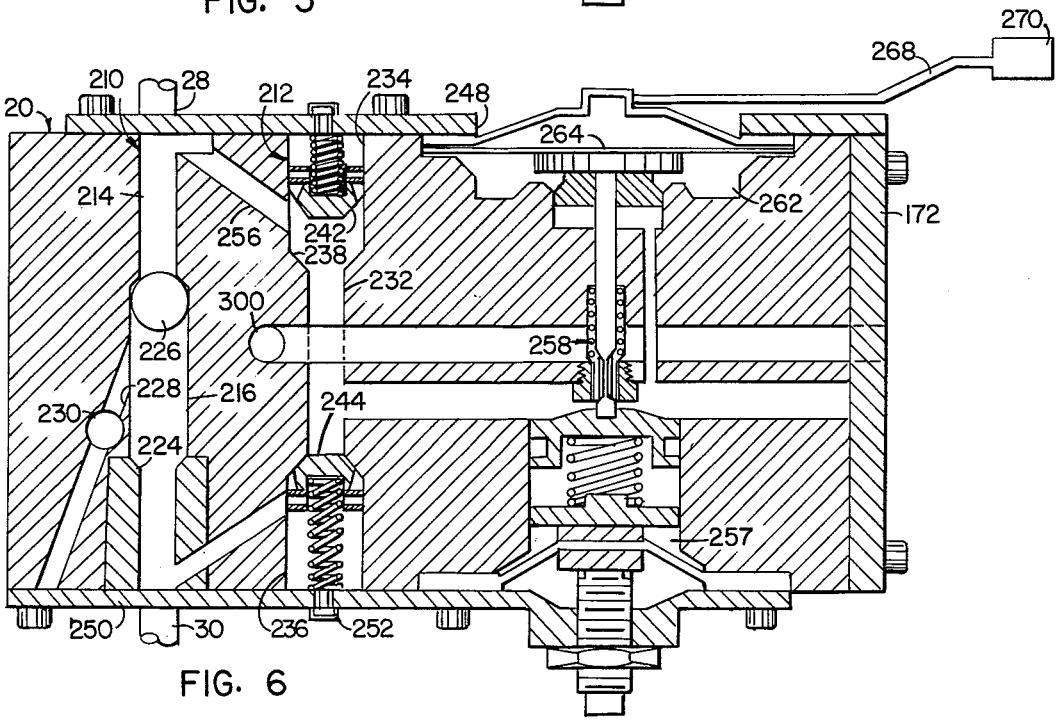
FIG. 6 is a view similar to FIG. 5 but illustrating the liquid refrigerant flow valve in the cooling mode.

With reference to FIGS. 5 and 6 the liquid portion of the converter is illustrated as formed in the common block as the gas portion and the accumulator portion. Formed transversely through the block are adjacent first and second passageways 210 and 212 respectively. The first passageway 210 includes a bore 214 of a first diameter and opens into a larger diameter portion 216, the interface being countersunk at 218. The other side of the passageway is of a diameter substantially larger than that of the portion 216 for receiving an insert 220 having a communicating bore 222 of a diameter substantially equal to that of the bore 214. The insert includes a countersink 224 where it opens into the portion 216. Positioned within the larger diameter portion 216 of the passageway, before the insert is in place, is a ball valve 226 of a larger diameter than the bores 214 and 222 and adapted to seat in the countersinks 218 and 224. Another passageway 228 opens into the portion 216 and a bore 230 opens into the passageway 228 and extends upwardly to the accumulator to communicate with the bore 204.

The second passageway 212 has a central bore 232 and enlarged portions 234 and 236 on each side thereof, the interfaces therebetween having countersunk rims 238,240 respectively. Disposed in each of the bores 234,236 is a respective check valve piston member 242,244 having truncated faces complementary to the respective countersink for sealing therewith. A spring 246 is disposed in a recess in the rear of each piston 242,244 for urging the piston into sealing engagement to seal the central bore 232 unless overcome by the liquid pressure on the face of the piston, as hereinafter described, each spring being restrained by a respective passageway closing plate 248 and 250 acting on the spring. External means such as a threaded rod 252 acting against a retainer member between the spring and the respective plate 248,250 may act to adjust the spring bias as may be needed in various geographical locations; alternately the springs may be exchanged for this purpose. Disposed in front of the face of piston 244 when it is in the unseated or heating position as illustrated in FIG. 5 is a passageway 254 which communicates the bore 236 with the bore 222 of the insert 220, the latter having a passageway in line therewith. A similar passageway 256 communicates the bore 234 in the front of the face of piston 242 when unseated in the cooling or air conditioning mode, as illustrated in FIG. 6, with the bore 214.

Formed transversely in the liquid portion of the block is a cavity 257 that extends about midway therethrough and communicates with a first bore illustrated generally at 258 and a smaller bore 260, each extending toward the other side and opening into another cavity 262. These cavities and bores carry the expansion valve, which comprises conventional elements, but positioned within the block. Thus, disposed over and closing the cavity 262 is a rubber diaphragm 264 over which a metal diaphragm 266 is positioned and held in place by the plate 248. The metal diaphragm 266 has a vent communicating with a tube 268 connected to a vapor temperature bulb 270 at the inside coil 214. Disposed adjacent the rubber diaphragm 264 remote from the metal diaphragm is the face of a plunger 272, the other face of which has a pair of rods 274 (only one of which is shown) which act in conjunction with a spring 276 against a hollow metering pin valve member 278. A cooperating pin 280 is disposed against an equilization piston 282 in the cavity 256. Another spring 284 is disposed between the piston 282 and a support member 286 having a block 288 that is sandwiched about another flexible diaphragm 290. An adjusting screw 292 acts against the block 288 to adjust the spring and extends through the plate 250 where it is secured by a nut 294. The bore 260 acts an as internal equilizer and communicates the plunger 272 with a passageway 296 that opens into the bore 232. Another passageway 298 communicates with the hollow pin valve member 278 and opens into a bore 300 that extends upwardly and communicates with the bore 206 in the accumulator. Thus, the liquid entering from the accumulator at line 300 flows into passageway 298 and passes through the hollow valve member 278 where its pressure is dropped as it enters the passageway 296.

In operation, when the mode selector within the building is switched to the heating mode, the solenoid valve 152 is electrically positioned such that the high pressure gas from line 24 and passageway 162 enters the bore 160 and is directed by the valve out the bore 156 and into passageway 166 at the right side of the cavity 40 as viewed in FIG. 3. Thus, high pressure gas enters the cavity 40 to act upon the large main piston 96 thereby to force the piston 96 toward the left. Since the piston 96 is larger than the piston 68 it overcomes any force applied on piston 68 by the high pressure gas which may be on the left side of the piston 68 as a residual from the air conditioning mode. The parts are thereby positioned in the heating mode as illustrated in FIG. 3 with the piston 80 closing the bore 142 and the hub member 136 and seal 137 closing the opening 44. High pressure gas thus entering from line 24 enters the cavity 58 and flows through the passageway 138 into line 26 to the inside coil 14 where it condenses to a liquid.

The liquid leaves the inside coil through line 28 and enters the liquid portion of the converter through the passageway 210 forcing the ball 226 and the check valve member 242 to the positions illustrated in FIG. 5. Thus, the high pressure liquid flows through the bore 230 up into the accumulator portion of the converter through the coil 198 into the filter 190 and back down into the liquid portion of the converter through the bore 300 and into the passageway 298. The high pressure liquid thereafter flows through the expansion valve member 278 where its pressure is dropped and flows through the passageway 296 to force the check valve member 244 away from the passageway 254 thereby to allow the low pressure liquid to enter the passageway 254 and out the line 30 to the outside coil 16 where it takes on heat and vaporizes.

The low pressure vapor thereafter flows through the line 32 back to the gas portion of the converter where the position of the piston 80 forces the low pressure gas to take the path upwardly through the bore 146 into the passageway 150, across the valve body, and down into the bore 176 into the cavity 38. This low pressure gas then flows from the cavity 38 through the bore 168 into passageway 170 and down into the accumulator. Any droplets of liquid trapped in this gas is precipitated into the accumulator while the low pressure gas continues through the bore 186 through the filter 188 and out the line 34 to the inlet of the compressor 12. It should be noted that a portion of the low pressure gas that flows through the cavity 38 into line 70 enters the bore 158 and is directed through the solenoid valve 152 back through line 154 and into line 164, but this low pressure gas is prevented from entering the cavity 40 due to the high pressure gas in the right side of the cavity acting upon the face 104 of the piston 96.

When the mode selector is switched to the air conditioning mode the solenoid valve is moved so that the high pressure gas flows from bore 160 through the solenoid valve into bores 154 and 164, and the low pressure gas is directed by the solenoid valve into bores 156 and 166. Thus, high pressure gas acts against the conical surface 112 of the seal 108. This forces the seal away from the surface 62 and allows the high pressure gas to bleed into the cavity 40 on the left side of the main piston 96. Since low pressure gas is now on the right side of the piston 96 the piston begins to move toward the right and as more gas enters the cavity, the piston is forced to the position illustrated in FIG. 4 with the piston 122 closing communication from the bore 176 to cavity 38, and the hub 72 closing the bore 60.

The high pressure gas from the compressor thus enters the cavity 58 and flows through the bore 142 to line 32 to the outside coil 16 where the gas condenses to a liquid. The high pressure liquid flows through line 30 from the outside coil and into the passageway 210 to force the ball 226 against the seat 218 and to force the check valve piston 244 against its seat 240. The high pressure liquid thereafter flows through the bore 230 upwardly into the accumulator through the coil 198, the filter 190 and back down through the bore 300 into passageway 298 of the liquid portion of the converter. The high pressure liquid thereafter passes through the expansion valve where its pressure is dropped and it thereafter flows through the passageway 296 through the bore 232, through passageway 256 and out the line 28 to the inside coil 14. The low pressure liquid in the inside heat exchanger coil takes on heat, vaporizes and flows out line 26 to the gas portion of the converter where it enters the cavity 38 at the left side of the piston 120 and exits therefrom through the bore 168 into passageway 170 where it enters the accumulator. The low pressure gas thereafter flows through the bore 186 and the filter 188 and out line 34 to the inlet of the compressor 12.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. Apparatus for directing a refrigerant from a compressor to a first heat exchanger located within a building and a second heat exchanger located outside the building selectively to cool and heat the first heat exchanger with said refrigerant, said apparatus comprising a housing, a first passageway formed in said housing for receiving high pressure gaseous refrigerant from the outlet of said compressor, means defining first and second cavities in said housing, means communicating said first cavity with said first passageway, means communicating said second cavity with the low pressure inlet side of said compressor, a reversing valve having operator means slideably mounted for movement in said cavities between two positions, means for moving said operator means selectively to one of said positions, a second passageway in said housing communicating with said first cavity when said operator means is in a first position and closed by said operator means when in the second position, a third passageway in said housing communicating with said cavity when said operator means is in said second position and closed by said operator means to communicate with said cavity when in the first position, means for communicating said second passageway with said second heat exchanger, means for communicating said third passageway with said first heat exchanger, a fourth passageway formed in said housing, means for communicating one end of said fourth passageway with said first heat exchanger and means for communicating with the other end of said fourth passageway with said second heat exchanger, a second valve operator disposed in said fourth passageway and moveably directed to a first position by high pressure liquid refrigerant from the second heat exchanger when said reversing valve operator is in the first position to close said passageway to the first heat exchanger and moveably directed to a second position by high pressure liquid refrigerant in the first heat exchanger when said reversing valve operator is in the second position to close said passageway to the second heat exchanger, an expansion valve having an inlet and an outlet mounted in said housing for lowering the pressure of liquid refrigerant flowing therethrough, means communicating the inlet of said expansion valve with said fourth passageway, a fifth passageway formed in said housing and communicating said outlet of said expansion valve with said first and second heat exchangers, check valve means in said fifth passageway moveably directed to close communication between said expansion valve outlet and said second heat exchanger when said reversing valve operator means is in the first position and to close communication between said expansion valve outlet and the first heat exchanger when the reversing valve operator means is in the second position, a sixth passageway formed within said housing communicating said second cavity with said first heat exchanger when said expansion valve operator means is in said first position and closing communication therewith when in said second position, and a seventh passageway formed within said housing communicating said second cavity with said second heat exchanger when said reversing valve operator means is in said second position and closing communication therewith when in said first position.

2. Apparatus as recited in claim 1, wherein said means communicating said second cavity with the inlet of said compressor includes a third cavity formed in said housing defining an accumulator, an eighth passageway communicating said second cavity with said third cavity, and means including a ninth passageway in said housing communicating said third cavity with the inlet of said compressor.

3. Apparatus as recited in claim 2 wherein said means communicating the inlet of said expansion valve with said fourth passageway includes conduit means disposed in a bottom portion of said third cavity, a tenth passageway in said housing communicating said fourth passageway with one end of said conduit, and an eleventh passageway communicating said inlet to said expansion valve with the other end of said conduit.

4. Apparatus as recited in claim 3 including a first filter member in said ninth passageway, a second filter member in one of said tenth and eleventh passageways, means defining an access opening in said housing for entry into said ninth passageway and into said one of said tenth and eleventh passageways for access to said first and second filter members, and a closure member for closing said access opening.

5. Apparatus as recited in claim 1, wherein said reversing valve operator means comprises a first piston member disposed for movement in said first cavity and a second piston member disposed for movement in said second cavity, said first piston member including sealing means for closing said third passageway within said first position and sealing means for closing said second passageway when in said second position, said second piston member including sealing means for closing said seventh passageway when disposed in said first position and sealing means for closing said sixth passageway when in said second position, and means for mounting said first and second piston on a common rod for common movement from said first to said second positions.

6. Apparatus as recited in claim 5 including a third cavity disposed intermediate said first and second cavities, and wherein said reversing valve operator means includes a third piston member disposed in said third cavity and mounted on said common rod, said means for moving operator means comprising a pair of passageway means defined in said housing and opening into said third cavity, one of said passageway means communicating with said cavity at one face of said third piston and the other communicating with said cavity at the other face thereof, and valve means for selectively communicating refrigerant from said first passageway to one of said passageway means.

7. Apparatus as recited in claim 1 wherein said fifth passageway includes first and second oppositely disposed sections, a first channel opening into said first section for communicating said first section with said first heat exchanger, a second channel opening into said second section for communicating said second section with said second heat exchanger, said check valve means comprising a first valve member disposed in said first section for closing communication with said first channel, a second valve member disposed in said second section for closing communication with said second channel, each of said valve members having a first face disposed in the refrigerant path in the respective first and second sections and a second face disposed in the refrigerant path in the respective first and second channels when communication between the respective section and channel is closed, and biasing means for normally urging each of said valve members to close communication between the respective section and channel.

* * * * *